US008136666B2

(12) United States Patent
Goldman

(10) Patent No.: US 8,136,666 B2
(45) Date of Patent: Mar. 20, 2012

(54) DAILY DOSE PERSONAL PILL DISPENSER

(76) Inventor: Kenneth N. Goldman, New York, NY (US)

( * ) Notice: Subject to any disclaimer, the term of this patent is extended or adjusted under 35 U.S.C. 154(b) by 224 days.

(21) Appl. No.: 12/394,866

(22) Filed: Feb. 27, 2009

(65) Prior Publication Data

US 2010/0219198 A1 Sep. 2, 2010

(51) Int. Cl.
*B65D 83/04* (2006.01)
*B65D 51/18* (2006.01)

(52) U.S. Cl. ..... 206/538; 206/534; 220/253

(58) Field of Classification Search ..... 206/534, 206/538, 539, 570; 220/253; 221/25, 285, 221/68

See application file for complete search history.

(56) References Cited

U.S. PATENT DOCUMENTS

| | | | | |
|---|---|---|---|---|
| 1,817,562 | A | 8/1931 | Hodge | |
| 2,749,198 | A * | 6/1956 | Berber | 312/249.1 |
| 2,953,242 | A * | 9/1960 | Shaw | 206/534 |
| 3,276,573 | A | 10/1966 | Kaufman et al. | |
| 3,398,827 | A * | 8/1968 | Laskin | 206/499 |
| 3,921,806 | A | 11/1975 | Wawracz | |
| 3,926,335 | A | 12/1975 | Dangles et al. | |
| 4,039,080 | A | 8/1977 | Cappuccilli | |
| 4,164,301 | A * | 8/1979 | Thayer | 220/253 |
| 4,261,468 | A * | 4/1981 | Krebs | 206/538 |
| 4,572,376 | A * | 2/1986 | Wrennall | 206/538 |
| 4,593,819 | A * | 6/1986 | Will | 206/538 |
| 4,793,492 | A * | 12/1988 | Halbich | 206/538 |
| 4,838,453 | A | 6/1989 | Luckstead | |
| 5,193,704 | A * | 3/1993 | Kick | 220/253 |
| 5,322,166 | A | 6/1994 | Crowther | |
| 5,477,981 | A * | 12/1995 | Heyl et al. | 221/86 |
| 5,756,977 | A * | 5/1998 | Biss | 235/7 R |
| 5,762,199 | A | 6/1998 | Aguilera | |
| 5,782,359 | A | 7/1998 | McAllister et al. | |
| 6,068,158 | A | 5/2000 | Chabout | |
| 6,126,010 | A * | 10/2000 | Kogen | 206/570 |
| D451,666 | S | 12/2001 | Zastrow | |
| 6,564,945 | B1 | 5/2003 | Weinstein et al. | |
| D502,801 | S * | 3/2005 | Baum | D3/203.3 |
| 7,100,793 | B2 * | 9/2006 | Baum | 221/15 |
| 7,128,213 | B2 | 10/2006 | Tung et al. | |
| 7,147,127 | B2 * | 12/2006 | Lepke et al. | 221/4 |
| 2007/0184078 | A1 | 8/2007 | Chen | |
| 2007/0261985 | A1 | 11/2007 | Allen | |
| 2008/0272022 | A1 | 11/2008 | Kulkarni et al. | |

* cited by examiner

*Primary Examiner* — J. Gregory Pickett
*Assistant Examiner* — Kaushikkumar Desai
(74) *Attorney, Agent, or Firm* — Alston & Bird LLP

(57) ABSTRACT

The apparatus and method of the present invention provide for the simple and accurate dispensing of articles, particularly solid oral medication. The apparatus of the present invention according to one embodiment comprises a holder device, in which said holder device comprises a bottom surface, a sidewall engaging said bottom surface, a pair of radial walls adjoining a center of said bottom surface and said sidewall, and a sloped slide adjoining said pair of radial walls. In a preferred embodiment, the holder device further comprises seven pairs of radial walls to correspond with each day of the week. The present invention also includes a plurality of compartments within each pair of radial walls, which correspond to the time periods during which medication must be taken during a single day. Each compartment according to this embodiment contains a sloped slide. The present invention further provides a method for loading the apparatus whereby a filling tray with wells is placed on the holder device, the filling tray is arranged so that each well empties into a compartment, a number of articles are poured onto the filling tray, and spread over the tray so that the desired number of articles fall into each well. The embodiments of the present invention further describe methods for administering and storing articles.

18 Claims, 7 Drawing Sheets

DAILY DOSE PERSONAL PILL DISPENSER

FIELD OF INVENTION

The present invention relates in general to an apparatus for dispensing articles. In particular, the present invention relates to an apparatus for dispensing solid oral medication, including pills, tablets and capsules.

BACKGROUND OF THE INVENTION

Physicians, third party payers and patients are all stakeholders in the health care system. All participate in decision making, all have an interest in successful outcomes and all are cognizant of costs and cost benefits. The present invention (sometimes referred to herein as the "Daily Dose") will have a positive impact on healthcare outcomes and the costs of drug inventory, distribution, customer purchase, as well as safety, use and treatment.

Major obstacles with drug dispensing include the increasing cost of the drugs, followed by prescribing and dispensing errors, followed by poor patient compliance, i.e., whether or not the patient has faithfully taken all of the prescribed pills over the entire course of time for which they were prescribed. Poor patient compliance leads to enormous costs with respect to wasted drugs and sub-optimal treatments. The effects of sub-optimal treatments can be exponential as they may lead to lingering or recurrent illness(es), thus demanding more doctor visits, more hospitalization and more surgical and/or medical treatment.

Prior art devices that dispense articles, specifically medication, fail to fully address these problems. Rather, prior art medication dispensers are generally of a small scale which makes it difficult for a patient, especially an elderly, arthritic or handicapped patient, to retrieve pills from the device. Also, a number of prior art dispensers only dispense one pill at a time. Examples of devices that dispense a single pill per day can be found in U.S. Pat. Nos. 3,533,371; 3,495,567; and 3,743,085. Further, prior art pill dispensers, such as U.S. Pat. Nos. 3,276,573 and 6,564,945 include deformable blisters, which, in reality, are difficult for many patients to use. Again, patients such as the elderly, arthritic and handicapped commonly struggle with medication sealed within a blister package.

Many prior art devices, such as that described in U.S. Pat. Nos. 4,039,080, are characterized by a box-like configuration, which makes it difficult for the patient to reach into the particular box containing medication. Additionally, tablets, pills or capsules may become caught, trapped, or positioned in these devices so as to render retrieval and use difficult. This obliges the user to turn, flip, invert, tap or adjust the device in various ways which risks or inevitably leads to having the oral medication, for example, pills, spill out of the container, or become intermixed, or damaged or lost.

The present invention overcomes these notable challenges by providing an apparatus for dispensing articles, in most instances oral medication, that allows the patient to easily select or identify what medication needs to be taken and when. In addition, the present invention allows for safe, easy and simple access to and dispensing of said medication.

SUMMARY OF THE INVENTION

The present invention is designed to dispense prescribed therapeutic drugs to patients in a manner not used or described heretofore. The dispenser is easy to load by the drug supplier and very user friendly for the patient or care provider, who want to be compliant in using and administering the drug(s), but face non-obvious obstacles, such as personal disorganization, difficulty with opening and accessing the contents, forgetfulness, and inattention.

In a first embodiment, the apparatus of the present invention comprises a holder device, which comprises a bottom surface and a sidewall engaging said bottom surface. The holder device includes at least a pair of radial walls positioned between a center of the bottom surface and the sidewall, and a sloped or inclined slide is positioned between said pair of radial walls. In this most basic embodiment, a single pill, tablet or capsule (hereinafter generally referred to as "pill") or plurality of pills may reside between the radial walls at the base of the sloped slide. The patient is then able to reach with his or her finger into the space between the pair of radial walls and easily guide the pill(s) up the slide and into his or her hand, whereupon the patient may then use the medication.

In one preferred embodiment, the apparatus of the present invention has seven pairs of radial walls that store pills for each day of the week. Ideally, the apparatus further comprises designations for each day of the week in close proximity to the corresponding pair of radial walls. In a more preferred embodiment, between each pair of radial walls is a plurality of pill compartments. The number of compartments may correspond to the number of times a person is required to take medication throughout a particular day. For instance, a person that is required to take medication three times a day (e.g., at breakfast, lunch and dinner) would use an apparatus of the present invention with three pill compartments between the radial walls. The arrangement of the medication within the present invention allows for a patient to manage a large number of pills, without having to recall which pills need to be taken and when. Similarly, the patient's caregiver (nurse, spouse or family member) can easily determine which doses have or have not been taken. The dispenser of the present invention reduces the chances that a patient will miss a dose or duplicate a dose. The Daily Dose also facilitates multi-pill dosing. This invention provides significant value to the elderly and handicapped who frequently are prescribed large quantities of medications for various ailments, but who may have trouble keeping track of such medication.

In another preferred embodiment, the present invention is of a larger scale than those presently found in the prior art, such as U.S. Pat. No. 5,762,199, which, according to its title, is meant to fit in one's pocket. In a more highly preferred embodiment the Daily Dose is large enough so that a patient can easily fit his or her finger into each pill compartment. It is further large enough so that a person can easily read any weekday designations indicated near the pair of radial walls. According to one preferred embodiment, the bottom surface of the pill dispenser is twelve inches in diameter. The larger scale of the present invention differentiates it from the prior art and provides many novel advantages. For example, the size of the unit will make it easy for a handicapped, elderly or arthritic patient with limited dexterity to use it. Often this patient population struggles with opening blister packs and child-proof bottles. Moreover, the scale of the dispenser will allow those patients with impaired vision to easily see what medication needs to be taken on a particular day, as well as which medication has already been taken. Additionally, the large size of the dispenser will discourage patients from storing "extra" drug(s) in their medicine cabinet only to be used inappropriately at a later date (either using the wrong drug or an outdated drug).

The sloped slide that is included within the dispenser of the present invention is a novel element that additionally facilitates the withdrawal of medication. By virtue of the slide, a patient is able to easily guide the pills out of each compartment, without having the need to overturn the dispenser or agitate the dispenser in order to loosen pills. Rather, a patient simply needs to reach his finger into the pill compartment, make contact with the pills, push the pill(s) up the slide and into the patient's hand, from which the medication can easily be inserted into the patient's mouth.

A first method of the present invention provides for simple loading of the apparatus for dispensing articles, comprising placing a first filling tray on the holder device, wherein the filling tray comprises a plurality of wells of a predetermined area and depth. The first filling tray is then arranged over the holder device so that each well empties into a corresponding pill compartment. A predetermined number of articles, for instance, a week's worth of a certain pill, are then poured onto the first filling tray and spread over the tray such that the desired number of pills falls through each well and into the desired compartment. This loading of the apparatus can easily be done by a pharmacist. In another embodiment, the pharmacist can repeat the above-described steps with a second filling tray. The second filling tray may have wells at locations different from the first filling tray, such that a second pill type can be loaded in different compartments within the holder device or perhaps only a portion of the compartments previously loaded with a first pill type. In a preferred embodiment, the patient will use the dispenser of the present invention after it has been preloaded and a transparent seal applied by the pharmacist.

Additional methods of the present invention describe processes for administering articles, as well as storing articles. Administering articles according to one embodiment of the present invention simply requires a person to insert his or her finger into the apparatus, in particular into a pill compartment; push the article up a sloped slide; and drop the article into one's hand. This method of administration can be performed by a patient wishing to self-administer medication without expending much, if any, effort. Similarly, storing items according to the present invention can be easily done by loading the device and applying a top surface to protect the articles inside.

As is evident, the dispenser of the present invention avoids the need for a patient to remember which pills have to be taken at given time on any given day. Rather, the preloaded Daily Dose contains a patient's weekly medication and serves as a visual reminder of what pills need to be taken on what day and when. A preloaded canister is further important because it will likely encourage the patient to use one pharmacy which will permit a single pharmacist to control dispensing and safeguard against negative drug-drug interactions. This preloaded apparatus is further advantageous in that it will compliment the lifestyle of a patient on long-term chronic medications, who simply cannot individually manage the number of medications and dosage times over several months, or longer. The Daily Dose essentially does all the work for the patient and/or caregiver.

The benefits of the present invention, which demonstrate its superiority to the medication dispensers known in the art, are significant and substantial. The Daily Dose avoids the need for a patient to keep his or her bottles of pills organized. Further, with the Daily Dose, the patient no longer has to open multiple bottles of pills at any one given time during the day. Indeed, the patient will not have the chore of opening bottles of pills at all. The present invention further prevents a patient from opening the wrong bottle of pills that are poorly labeled or not readily deciphered by a specific patient, and thereby potentially taking the wrong pill entirely. Further, the Daily Dose circumvents privacy issues potentially caused by leaving the labels on plastic bottles only to be found or revealed in the garbage.

The present invention is further ideal because its design and loading compliment the increasing use of electronic prescribing ("e-prescribing"). E-prescribing is an electronic transmission of a patient's prescription, whereby the doctor electronically submits a patient's medication prescription to a clearing house. It is the clearing house that receives information from the patient's insurance company regarding what medication is covered by a person's health insurance policy, whether the patient can be prescribed generic medication, what medications the patient is presently on, and whether any negative cross-reactions could occur, among other things. E-prescribing allows for better and more efficient care at lower cost compared to the conventional method.

In contrast to e-prescribing, in the conventional prescribing method, a doctor writes a prescription, gives the prescription to the patient, who then takes it to a pharmacist, and at the pharmacy the patient is forced to wait or either come back pending approval from his or her insurance company.

With the present invention, upon receiving an e-prescription or multiple e-prescriptions for a patient, the pharmacist can load the subject dispenser with the patient's weekly medication. The pharmacist could further load more than one dispenser so that the patient can take home one month's worth of medication. This is particularly useful for most patients who are on chronic drug administration, wherein the prescriptions rarely change from one month to the next. As a result, when the patient goes to the pharmacy to pick up his or her medication, he or she can take home a preloaded dispenser according to the present invention and already have his or her pills appropriately segregated for the proper day and dosing periods.

BRIEF DESCRIPTION OF THE DRAWINGS

Having thus described the invention in general terms, reference will now be made to the accompanying drawings, which are not necessarily drawn to scale.

Figure 1:
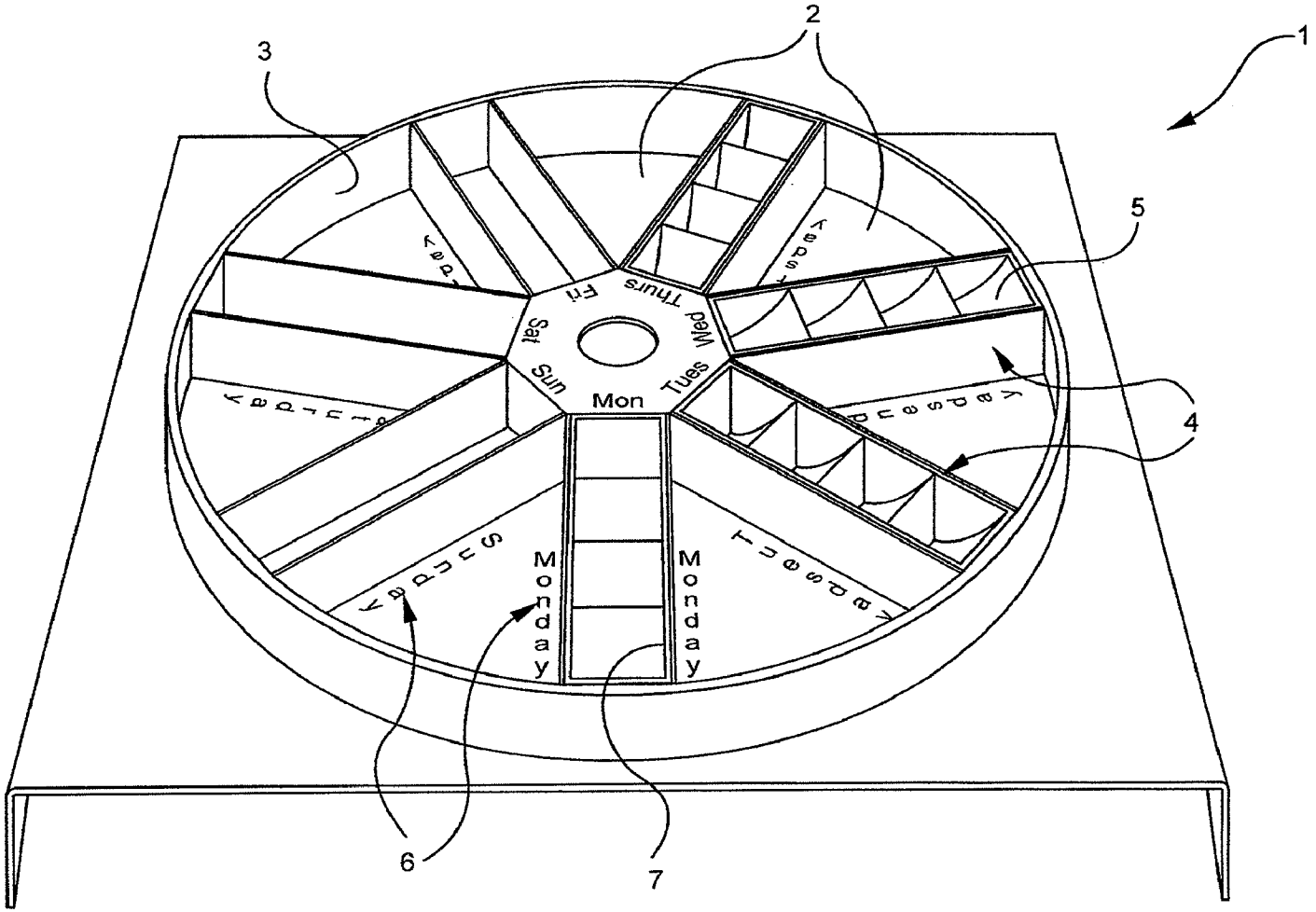

FIG. 1 is a front perspective, isometric view of one embodiment of an article dispenser.

Figure 2:
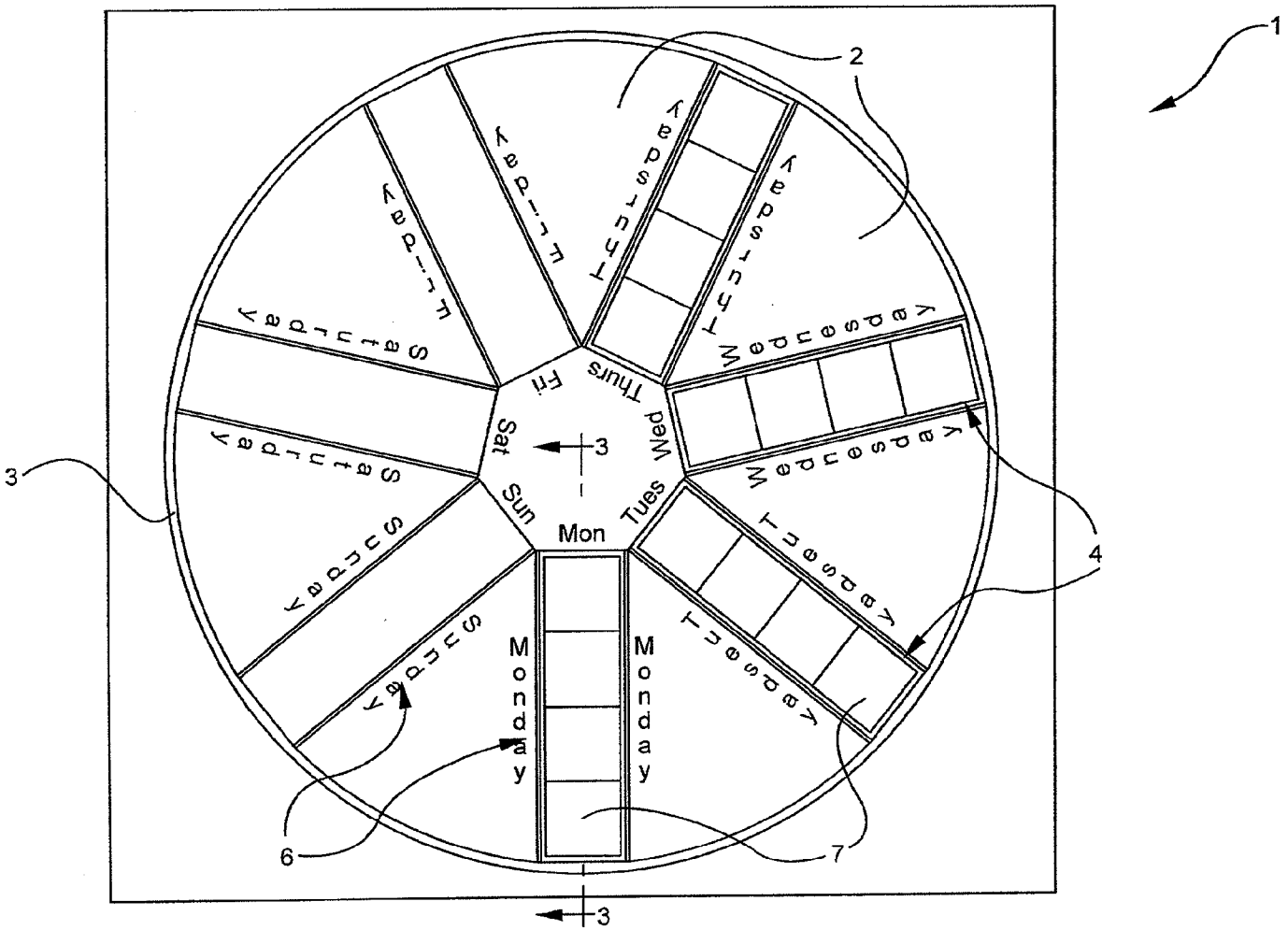

FIG. 2 is plan view of another embodiment of an article dispenser.

Figure 3:
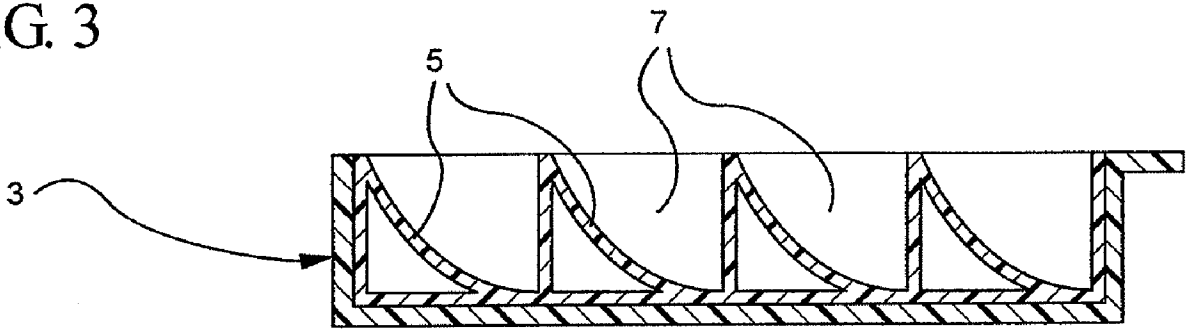

FIG. 3 is a side view of a row of pill compartments within a pair of radial walls according to a further embodiment.

Figure 3B:
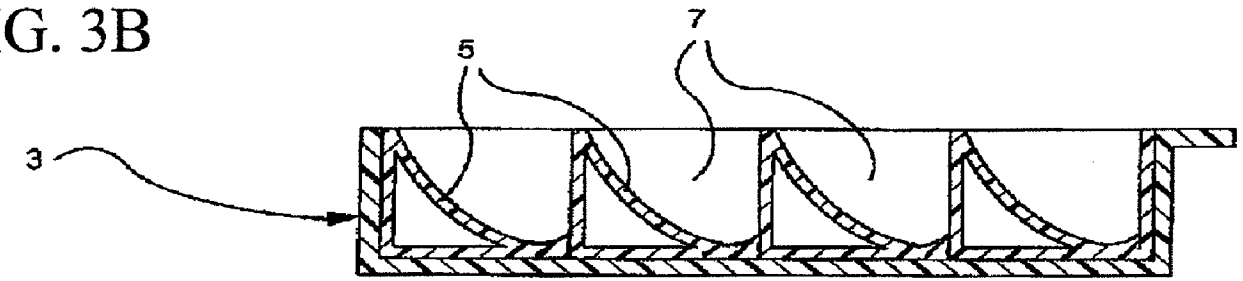

FIG. 3B is a side view of a row of pill compartments within a pair of radial walls according to an additional embodiment.

Figure 4:
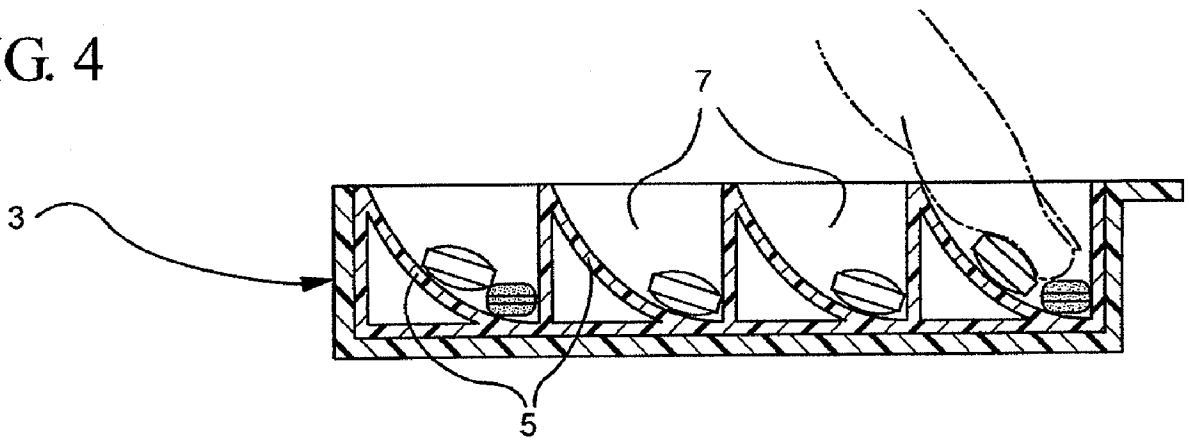

FIG. 4 is a side view of a row of pill compartments within a pair of radial walls containing solid oral medication according to another embodiment.

Figure 5:
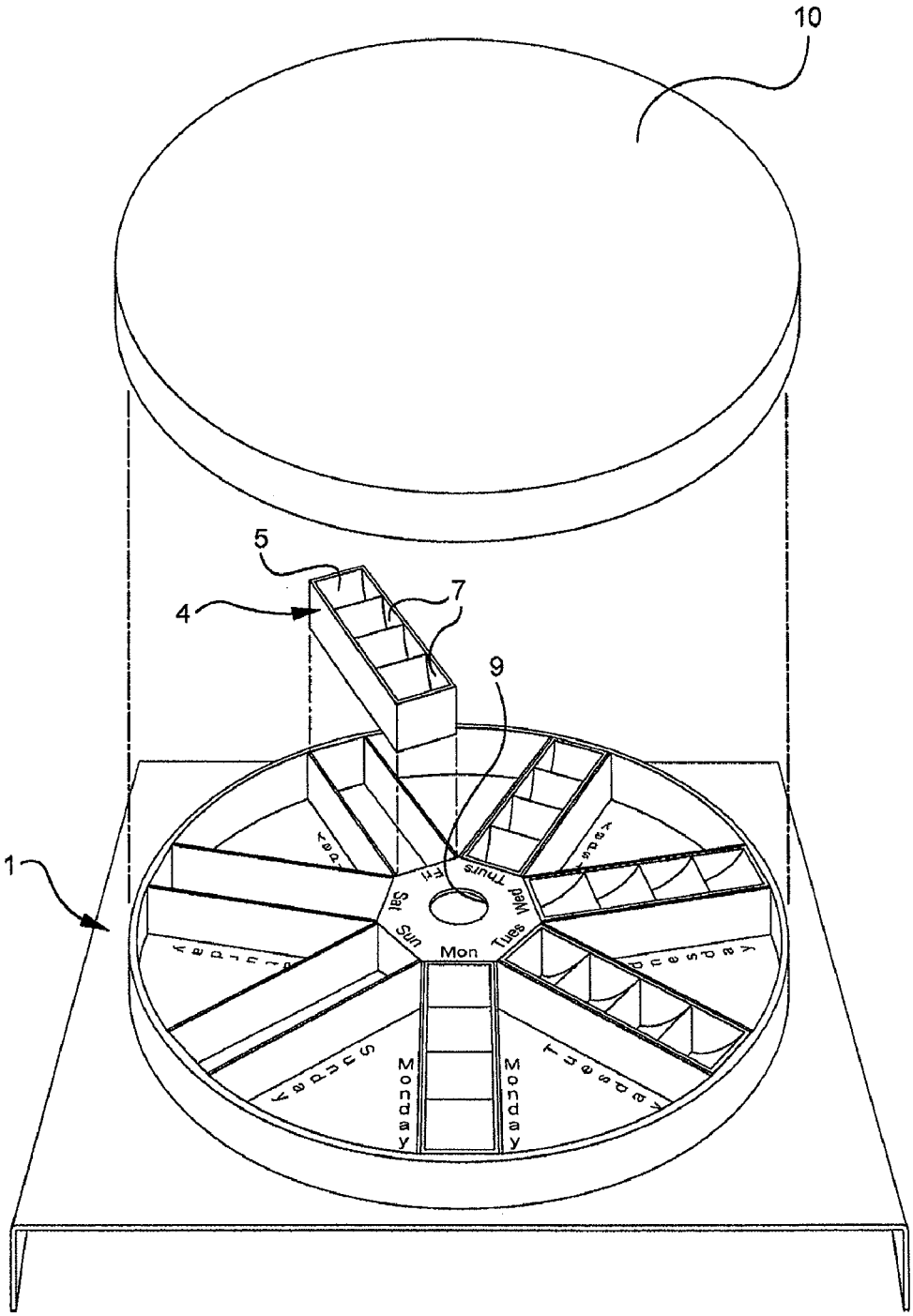

FIG. 5 is a front perspective, exploded view of one embodiment of an article dispenser, showing a detachable row of pill compartments and a first top surface.

Figure 6:
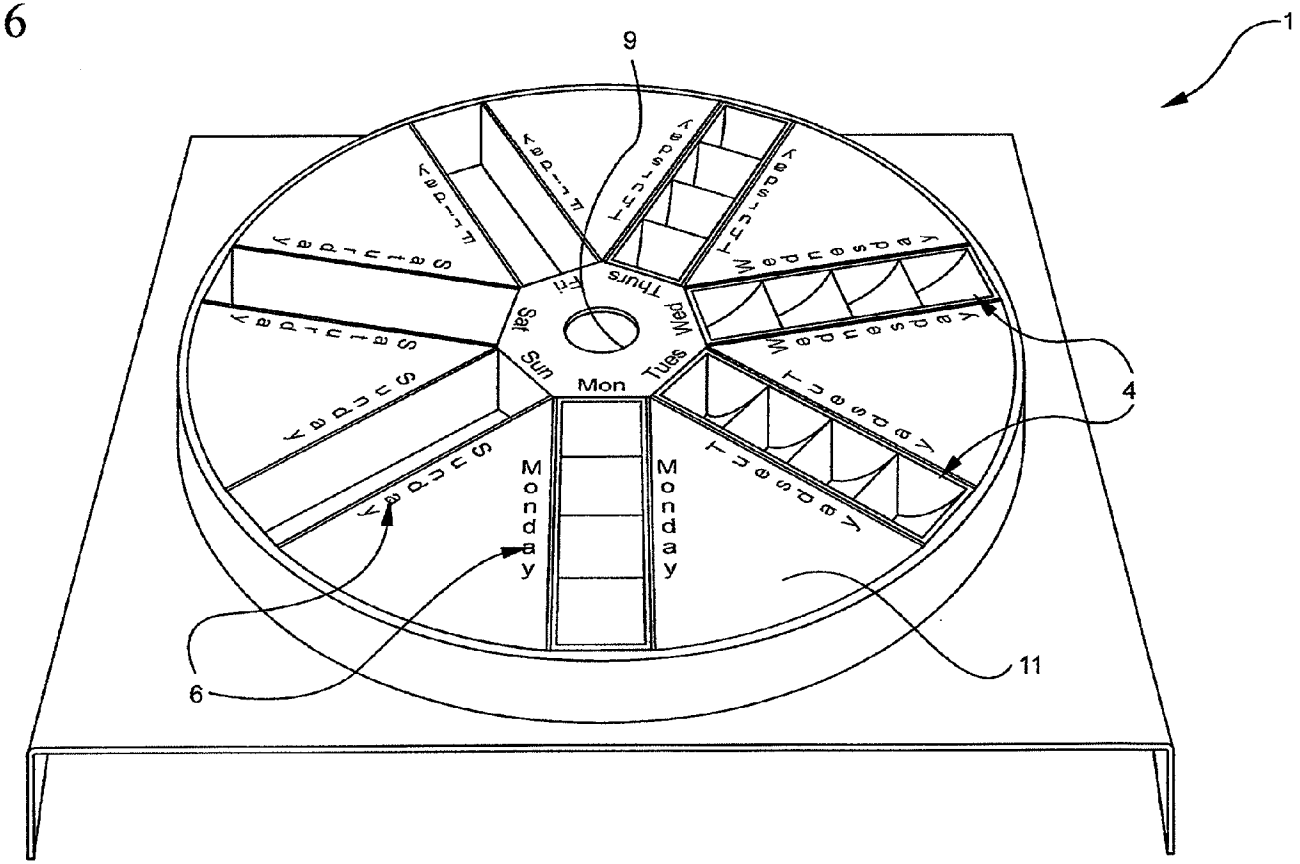

FIG. 6 is a front perspective, isometric view of an article dispenser according to one preferred embodiment showing a top surface between pairs of radial walls.

Figure 7:
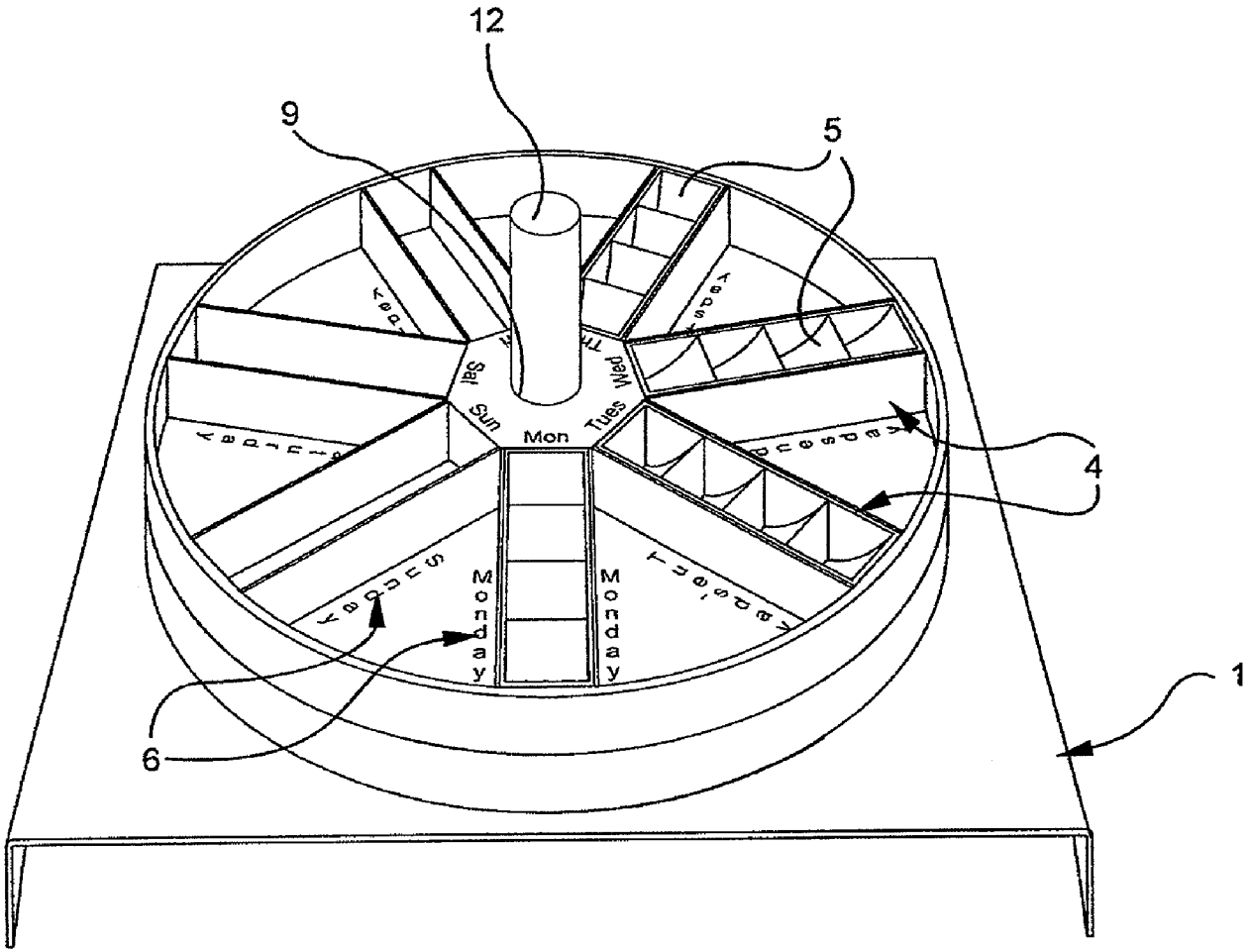

FIG. 7 is a front perspective, isometric view of two stacked dispensers according to an additional embodiment.

Figure 8:
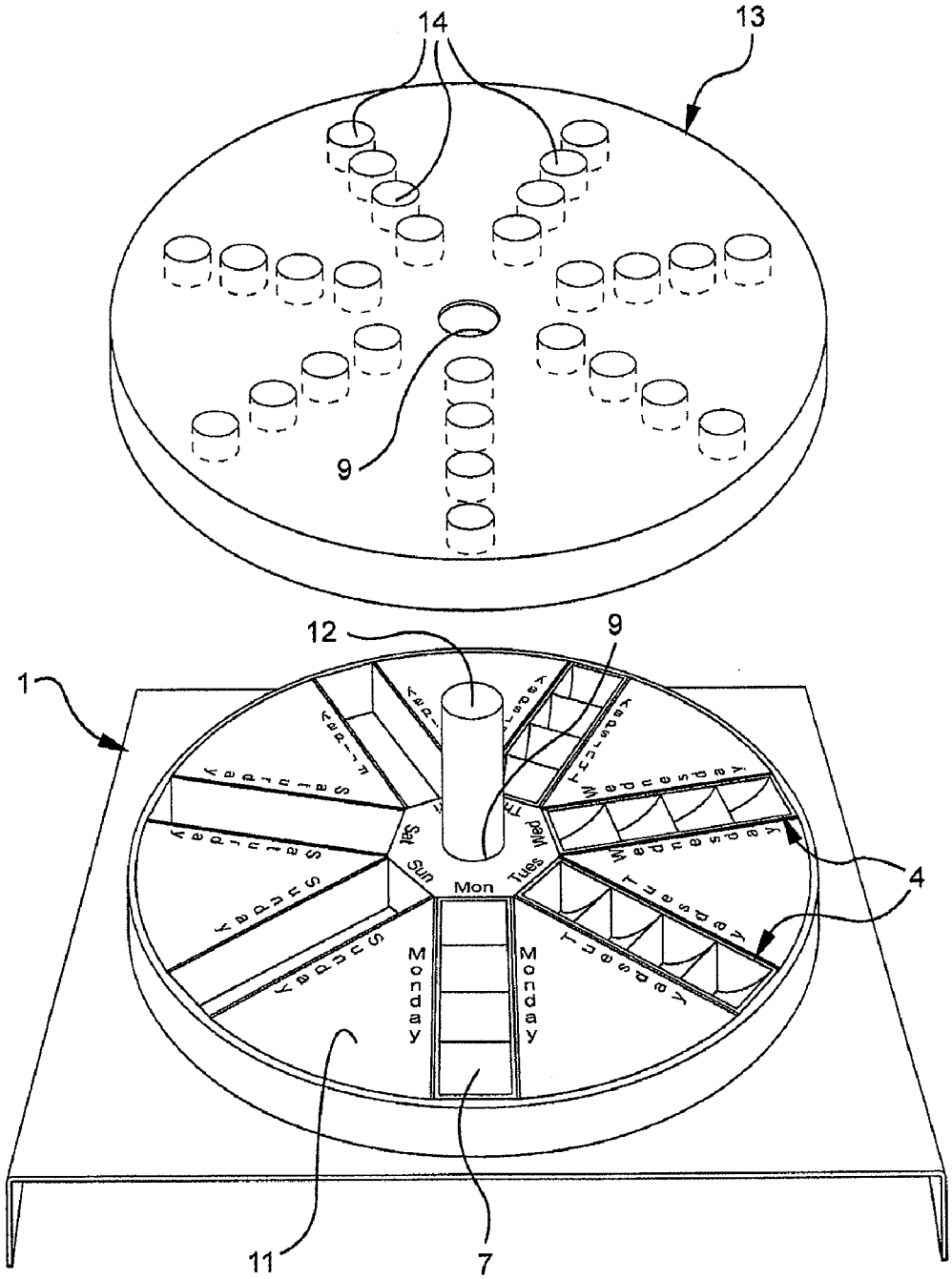

FIG. 8 is a front perspective, isometric view of an article dispenser and filling tray according to a further preferred embodiment.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

Generally speaking, in one embodiment of the present invention it provides an apparatus for dispensing articles, particularly solid oral medication. A desirable apparatus of the present invention is a holder device which comprises a flat bottom surface, a sidewall mounted on said bottom surface, a pair of radial walls positioned between a center of said bottom surface and said sidewall, and a sloped slide between said pair of radial walls. In another embodiment of the present invention, it discloses a process for loading the apparatus, which comprises placing said first filling tray on the holder device, arranging the first filling tray so that each well of the filling tray empties into a compartment, pouring a predetermined number of articles onto said first filling tray, and spreading the articles over the first filling tray so that a second predetermined number of articles falls into each well. In still further embodiments of the present invention, it provides for a method of administering articles and storing articles.

FIG. 1 is a front perspective, isometric view of one embodiment of an apparatus for dispensing articles according to the present invention. The embodiment illustrated in FIG. 1 is an article dispenser comprising a holder device 1 having a flat bottom surface 2, a sidewall mounted 3 on said bottom surface 2, and a pair of radial walls 4 positioned between a center of said bottom surface 2 and said sidewall 3, and an sloped slide 5 between said pair of radial walls 4. In this preferred embodiment, the holder device 1 contains seven pairs of radial walls 4, in addition to indicia 6 for each pair of radial walls. In this particular embodiment, the indicia 6, placed in proximity to one of each of said pairs of radial walls, are designations for each day of the week. In other preferred embodiments, the indicia may be text (for instance instructions such as take AFTER meal, or the name of the drug, etc.), tactile marks, color, or light. In a highly preferred embodiment, as shown here, the weekday designations are positioned adjacent to the exterior walls of the pair of radial walls 4. By positioning the weekday designations on each side of the pair of radial walls 4, this configuration alleviates confusion as to which pills are to be taken during which day. Furthermore, the addition of indicia 6 on the center of the holder device makes it unambiguously clear which row of pills correspond to a particular day.

Furthermore, in this preferred embodiment, a plurality of compartments 7 are within said pair of radial walls 4. Each compartment 7 houses one or more pills. FIG. 1 shows four pill compartments 7 for each day of the week. This configuration is ideal for a patient who is required to take medication at four different time periods throughout one day. In other embodiments, there can be one pill compartment for each day, two pill compartments for each day, or three compartments for each day, without limitation. A sloped, inclined or curved slide 5 is between said pair of radial walls 4, and more specifically, is within each compartment 7.

In the embodiment shown in FIG. 1, the flat bottom surface 2 of the holder device 1 is resting on a flat table-like surface. The present invention can be conveniently placed on a kitchen counter, particularly near a sink should the patient require water when taking his or her medication. Further, the pill dispenser can be placed on a person's nightstand near his or her bed, on a countertop in the bathroom, or on a kitchen table. For elderly and handicapped patients, it is ideal to keep the pill dispenser of the present invention in a noticeable location to further minimize the chance that he or she will forget to take his or her medication. Due to its large size, according to one embodiment, and location, it will be difficult to miss.

In another preferred embodiment, the apparatus for dispensing articles comprises seven pairs of radial walls, wherein the bottom surface is between said pairs of radial walls. Furthermore, the sidewall abuts said pairs of radial walls. According to this preferred embodiment, the present invention resembles a hub-and-spokes configuration. In a more preferred embodiment, the indicia used to identify the spokes corresponding to the days of the week may be color-coded radial walls and/or pill compartments.

FIG. 2 is plan view of a preferred embodiment of an article dispenser. This view of another preferred embodiment of the present invention shows a circular flat bottom surface 2. For all patients, but particularly patients who are elderly or arthritic, the radial walls 4 that envelop the medication are more user-friendly then prior art pill dispensers in which pill compartments for multiple days of the week are adjacent to and in contact with each other. In these prior art configurations, there is more danger that a patient will unintentionally retrieve a pill from a pill compartment associated with either the wrong day or the wrong time period. In sharp contrast, because the pill compartments 7 of the present invention in this particular embodiment are in a radial configuration, there is space between each row of pill compartments that correspond to a particular day. This configuration reduces, if not eliminates, the chances that a patient will accidentally take pills from the pill compartment 7 of the wrong day. Furthermore, the use of bold or prominent weekday indicia 6 can further decrease the instances of improper dosing.

As previously described, in a highly preferred embodiment, the present invention is of a large scale making the medication accessible to patients, especially the elderly, handicapped and arthritic. In another embodiment of the present invention the space between the radial walls of each pair of radial walls 4 is at least two centimeters, that is, the width of the pill compartment 7 is at least two centimeters. A width of at least two centimeters in this preferred embodiment allows for the compartment to be wide enough for a person's finger to be easily inserted into the compartment in order to retrieve the medication. The width of the compartment can be further varied in order to accommodate several pills of varying sizes. In an additional preferred embodiment, the space between the radials walls of each pair of radial walls is between about two centimeters and five centimeters.

FIG. 3 is a side view of one embodiment of a row of pill compartments 7 within a pair of radial walls, wherein the terminal pill compartment 7 abuts the sidewall 3. The side perspective of this embodiment of the present invention illustrates a sloped slide 5 within each of the four pill compartments 7. Ideally, a patient will retrieve pills by turning the holder device 1 so that the row of pill compartments for that particular day is directly in front of his or her body, and within each compartment the base of the slide 5 is furthest from the patient and the top of the slide 5 is closest to the patient.

FIG. 3B is a side view of an additional embodiment of a row of pill compartments 7 within a pair of radial walls. In this particular embodiment, a slide 5, within each of the four pill compartments 7, slopes slightly upward at the base of the slide. The bottom of the pill compartment 7 resembles a shallow valley. This embodiment prevents pills from being trapped at the bottom at of the pill compartment; thereby further facilitating retrieval of medication, especially for those patients who may have limited dexterity. Indeed, this embodiment has no sharp corners in which a pill may become lodged.

FIG. 4 is a side view of another embodiment of a row of pill compartments 7 within a pair of radial walls, wherein the terminal pill compartment 7 abuts the sidewall 3. This drawing shows a day's worth of pills and how the pills can be arranged within the pill compartments 7. The depiction of a patient's (or caregiver's) finger illustrates how one would retrieve medication from the pill dispenser of the present invention. One would simply and easily reach his or her finger into a pill compartment 7, push the pills up the sloped slide 5, toward his or her body, and drop the pills into the palm of his or her hand. Depending on the size and number of pills, the holder device 1 could dispense a complete and proper dosage by a single action of the patient. In prior art dispensers, a patient could be forced to reach two fingers into a pill compartment in order to grasp a pill, or one would have to extend a single finger into a pill compartment and attempt to lift the pill on top of one's finger and balance it as the pill is removed. The present invention avoids these problems. Instead, a patient's finger simply must make contact with the pill and guide the pill up the sloped, inclined or curved slide 5. There is no difficult maneuvering that must be done in order to withdraw the medication stored in a dispenser according to the present invention.

FIG. 5 is a front perspective, exploded view of a preferred embodiment of an article dispenser, showing a detachable row of pill compartments 7, a central aperture 9 and a first top surface 10. In this preferred embodiment, a first top surface 10 attaches to the holder device 1. This top surface 10 does not operate like a blister pack, as seen in the prior art, but rather functions as a soft cover which can effortlessly be punctured by human touch. As explained previously, blister packs present problems for the elderly, handicapped and arthritic because of the nature of the seal. Blister packs often have a firm seal which may be too difficult to penetrate, and often once punctured, it is troublesome extract the pill from the pack. In contrast, the top surface 10 of the present invention in one embodiment is easily pierced with a finger. In another embodiment, the top surface 10 may be a soft cellophane-like cover. In an additional embodiment of the present invention, the top surface 10 can be heat sealed to the holder device 1. The top surface 10 functions as a cover to keep the pills in place, but further serves a protective function, preventing contaminants from coming in contact with a patient's medication.

The top surface 10, according to a highly preferred embodiment, is transparent. A transparent top surface provides a clear view of what medication has been taken and what medication remains to be taken. This top surface 10 can cover the entirety of the holder device 1 or can cover solely the pill compartments 7.

Further, according to another preferred embodiment, as illustrated in FIG. 5, a day's worth (or more) of compartments 7 may be removed from the holder device 1. A detachable row of pill compartments 7 allows a patient to take his or her medication with him when he or she travels. The removable row of pill compartments 7 helps facilitates patient compliance with his or her doctor's prescription even when he or she is not at home.

The central aperture 9 allows for stacking of pill dispensers, shown later in FIG. 7, by placing each holder device 1 through an axle and positioning the devices 1 on top of each other.

FIG. 6 is a front perspective, isometric view of a preferred embodiment of an article dispenser showing a top surface 11 between pairs of radial walls 4. In one preferred embodiment, a top surface 11 lies exclusively between the first radial wall of one pair of radial walls 4 and a radial wall of another pair of radial walls 4. In the embodiment illustrated in FIG. 6, there are seven pairs of radial walls 4 and seven top surfaces 11. The top surface 11 further facilitates the effective dispensing of pills because it prevents the patient from accidentally dropping a pill into the negative space between the rows of pill compartments 7.

FIG. 7 is a front perspective, isometric view of two stacked holder devices 1 according to one preferred embodiment of the present invention. According to this additional embodiment of the present invention, the apparatus for dispensing pills comprises a base, wherein said base comprises an axle 12 having a circumference adapted to substantially fill the central aperture 9 of the flat bottom surface. Multiple holder devices can be placed through the axle 12 and stacked on top of each other. This embodiment is ideal for patients who wish to have more than one week's supply of medication in their possession. For instance, four stacked holder devices 1 would provide approximately one month's supply of medication. Ideally, when the patient goes to the pharmacy to pick up his or her monthly prescription for medication, the pharmacist can provide the patient with four preloaded pill dispensers, which can be conveniently stacked in accordance with FIG. 7. Once the patient takes the first week's supply of medication, he or she simply has to remove the top holder device 1 from the axle 12, and then proceed to take the next week's supply of medication from the next holder device 1.

In another preferred embodiment, the apparatus of the present invention is made of plastic. Plastic is one ideal material for the dispenser of the present invention because plastics are often inexpensive and therefore would not increase the cost of a patient's prescription. Further, a plastic dispenser can be returned to the pharmacist to be re-used for subsequent prescriptions. In an alternative embodiment, the pill dispenser can be made of a biodegradable material. According to this embodiment, the pill dispenser can be disposed of after use. In a still further embodiment, the pill dispenser can be made of recyclable material. In a highly preferred embodiment, the recyclable material is also sterilizable, allowing for safe and clean subsequent uses. These embodiments of the present invention are environmentally conscious in that they reduce waste that would be otherwise caused from empty pill bottles. Furthermore, and in the long-run, these embodiments allow for medications to be purchased at lower costs because new bottles are not needed and the same pill dispenser can be used over and over.

FIG. 8 is a front perspective, isometric view of an embodiment of an article dispenser and filling tray. In this preferred embodiment, the apparatus of the present invention further comprises a first filling tray 13. The first filling tray 13 comprises a central aperture 9, and the filling tray surface comprises a plurality of wells 14 of a predetermined area and width. The area and width of the wells can be adjusted such that they correspond with the area and width of each pill compartment 7. Furthermore, in another embodiment, the predetermined area and width of the wells accommodate a single pre-specified article, for instance one type of pill. In a highly preferred embodiment, the wells 14 are radially arranged. In a more highly preferred embodiment, the wells 14 have an identical radial arrangement to that of the pill compartments 7 in the holder device 1. It is preferred that when the first filling tray 13 is placed on top of the holder device 1, by placing the filling tray through the axle 12, the wells 14 empty directly into each pill compartment 7. This configuration allows for optimal and effective loading of the holder device 1.

In another embodiment, there may be a second filling tray which comprises a plurality of wells of a second predetermined area and height. According to this embodiment, the wells of the second filling tray can be located in the same or different positions from that of the first filling tray. But in any event, the wells of the second filling tray should empty directly into each pill compartment when the second filling tray is placed on top of the holder device. The area and height of the wells can be adjusted to compliment the size of the pill compartment or to accommodate a certain pill type.

As can be seen in FIG. 8, in an additional embodiment of the present invention, the pill dispenser comprises a base, wherein said base comprises an axle 12 having a circumference adapted to substantially fill the central aperture 9 of the flat bottom surface and a filling tray 13. In a further embodiment, the central aperture 9 in the bottom surface is substantially non-circular and the aperture 9 in said filling tray 13 is circular. This embodiment prevents the holder device 1 from rotating when the filling tray 13 is placed on top of the device and pills are being loaded into the apparatus.

The present invention according to a further embodiment also provides for a first method for loading an apparatus for dispensing articles comprising: placing a first filling tray 13 on the holder device 1; arranging the first filling tray 13 so that each well 14 empties into a compartment 7; pouring a predetermined number of articles onto the first filling tray 13; and spreading the articles over the first filling tray 13 so that a second predetermined number of articles fall through each well 14 and into a pill compartment 7. It is ideal that the holder device 1 of this embodiment contain a top surface 11, so that when the filling tray 13 is placed over the holder device 1, there is no negative space (besides the compartments) for the medication to fall. Additionally, in another preferred embodiment, the filling tray 13 contains a sidewall which prevents pills from spilling over the edge of the filling tray when the holder device is being loaded.

This first method can be used to fill the holder device 1 with a first type of medication. For example, if a person were prescribed bupropion hydrochloride in the morning and evening every day of the week, then the first filling tray 13 would have wells 14 that would correspond to the first and last pill compartments 7 within each pair of radial walls 4. The pharmacist would then place this first filling tray 13 over the holder device 1, pour fourteen pills of bupropion hydrochloride on the filling tray 13, spread the pills over the tray 13 so that one pill fell through each well 14 and into each first and last compartment 7, and finally remove the filling tray 13.

In another embodiment, a method for loading a pill dispenser comprises: placing a second filling tray 13 on the holder device 1; arranging the second filling tray 13 so that each well 14 empties into a compartment 7; pouring a predetermined number of articles onto the second filling tray 13; and spreading the articles over said second filling tray 13 so that a third predetermined number of articles falls through each well 14 and into a pill compartment 7. Continuing with the example in which a patient is prescribed bupropion hydrochloride, if he or she was also prescribed an anti-inflammatory agent to be taken in the middle of every day, then the second filling tray 13 would have wells 14 that would correspond with the middle compartment 7 within each pair of radial walls 4. The pharmacist would place this second filling tray 13 over the holder device 1, pour seven anti-inflammatory agents on the filling tray 13, spread the pills over the tray 13 so that one pill fell through each well 14, and finally remove the filling tray 13. This example of a fully loaded pill dispenser would contain at least three compartments for each day of the week: the first and last compartments containing bupropion hydrochloride and the middle compartment containing an anti-inflammatory agent. Upon taking the Daily Dose home from the pharmacy, the patient knows which pills need to be taken and when by virtue of their position within the pill dispenser. The patient is not required to recall when he or she must take bupropion hydrochloride, or when he or she must take an anti-inflammatory agent.

In an additional embodiment, the present invention includes a method for administering articles which comprises: inserting a finger into a holder device having a bottom surface, a sidewall engaging said bottom surface, a pair of radial walls adjoining a center of said bottom surface and said sidewall, and a sloped slide adjoining said pair of radial walls; stopping said finger upon making contact with an article at the base of said sloped slide; pushing said article up the slide; dropping said article into one hand after pushing the article up the length of said slide; and giving said article to a recipient. When administering oral medication, this method of administration can easily be performed by the patient or caregiver. As previously described, a person simply needs to guide the medication up the sloped slide. Little, if any, effort is required to complete these actions. Accordingly, a patient who is elderly, handicapped or arthritic can easily self-administer medication to himself or herself.

The present invention further includes another embodiment which provides a method for storing articles. One method of storing articles in an apparatus for dispensing articles comprises: placing a first filling tray having a plurality of wells on a holder device having a bottom surface, a sidewall engaging said bottom surface, a pair of radial walls adjoining a center of said bottom surface and said sidewall, and a sloped slide adjoining said pair of radial walls; arranging the first filling tray so that each well empties into a compartment between said pair of radial walls of the holder device; pouring a predetermined number of articles onto said first filling tray; spreading the articles over said first filling tray so that the desired number of articles falls into each well; removing said first filling tray; and applying a first top surface to said holder device. Pursuant to this preferred embodiment, one is able to store a plurality of articles in this holder device for an unlimited period of time.

Another method of storing articles in an apparatus for dispensing articles comprises: placing a first filling tray having a plurality of wells on a holder device having a bottom surface, a sidewall engaging said bottom surface, a pair of radial walls adjoining a center of said bottom surface and said sidewall, and a sloped slide adjoining said pair of radial walls; arranging the first filling tray so that each well is not aligned with a compartment between said pair of radial walls; pouring a predetermined number of articles onto said first filling tray; spreading the articles over said first filling tray so that the desired number of articles falls into each well; rotating said first filling tray so that the articles fall into the compartment between said pair of radial walls removing said first filling tray; and applying a first top surface to said holder device. According to this embodiment, the person loading the device, likely a pharmacist, has more control over what pills are placed within each well because the pills do not automatically fall into the pill compartment. Rather, once the precise amount of pills is placed into each well, the filling tray is rotated such that the pills simultaneously empty into the appropriate pill compartment.

In another embodiment, the loading steps can be repeated a plurality of times for each type of article, for instance each different medication, to be stored in the apparatus. The top surface is then added after all pill types have been loaded into the device. The top surface keeps the medication in place, but also aids in segregating the pills from any contaminants in the environment. In a more preferred embodiment, the top surface is sealed to the holder device. In a highly preferred embodiment, the top surface is heat-sealed to the holder device. In a highly preferred embodiment, the top surface is sealed to the holder device so that humidity does not enter the device and as a result degrade any medication inside. Different types of seals can be used to prolong the storage life of the medication within the holder device.

Often a patient with chronic conditions has many issues to manage related to his or her illness, and keeping track of what medications to take and when adds additional stress. The Daily Dose improves the patient's quality of life by organizing his or her medication, making it easily accessible and providing visual instruction as to when medication must be taken. The several embodiments of the present invention further provide methods for simple loading, administration and storage of medication.

That which is claimed:

1. An apparatus for dispensing articles comprising a holder device, said holder device comprising:

a. A bottom surface;

b. A sidewall engaging said bottom surface;

c. Seven pairs of radial walls adjoining a center of said bottom surface and said sidewall;

d. Indicia comprising designations for each day of the week placed adjacent to one of each of said seven pairs of radial walls;

e. Four pill compartments within each of said seven pairs of radial walls wherein each compartment comprises a sloped slide; and f. A separate three-dimensional space between each adjacent pair of said pairs of radial walls wherein said space lacks a pill compartment to safeguard against co-mingling of pill compartment articles.

2. The apparatus of claim 1 further comprising a first top surface on said holder device.

3. The apparatus of claim 2 wherein said first top surface can be punctured by human touch.

4. The apparatus of claim 2 wherein said first top surface is transparent.

5. The apparatus of claim 1 wherein at least a portion of said holder device is made of a biodegradable material.

6. The apparatus of claim 1 wherein at least a portion of said holder device is made of a recyclable material.

7. The apparatus of claim 6 wherein said recyclable material is also a sterilizable material.

8. The apparatus of claim 1 wherein at least a portion of said holder device is made of a plastic.

9. The apparatus of claim 1 further comprising a second top surface, wherein said second top surface covers at least a portion of said separate three-dimensional space between each adjacent pair of said pairs of radial walls.

10. The apparatus of claim 1 in which said bottom surface is substantially circular.

11. The apparatus of claim 1 further comprising a first filling tray, said first filling tray comprising a filling tray surface comprising a plurality of wells of a predetermined area and depth, in which said predetermined area is smaller than the area of each of said four pill compartments.

12. The apparatus of claim 11 in which said predetermined area and depth can only accommodate a single pre-specified article.

13. The apparatus of claim 11 in which said first filling tray comprises a sidewall.

14. The apparatus of claim 11 wherein said wells are radially arranged.

15. The apparatus of claim 11 further comprising a second filling tray, said second filling tray comprising a filling tray surface comprising a plurality of wells of a second predetermined area and depth.

16. The apparatus of claim 11 further comprising a central aperture in both said flat bottom surface and said first filling tray.

17. The apparatus of claim 16 further comprising a base, said base comprising an axle having a circumference adapted to substantially fill the central aperture of both said flat bottom surface and said first filling tray.

18. The apparatus of claim 17 in which said aperture in said bottom surface is substantially non-circular and the aperture in said first filling tray is substantially circular.

* * * * *